US012253283B1

(12) United States Patent
Gourlie

(10) Patent No.: US 12,253,283 B1
(45) Date of Patent: Mar. 18, 2025

(54) WATER HEATER WITH COMPACT HEAT EXCHANGER

(71) Applicant: Bock Water Heaters, Inc., Madison, WI (US)

(72) Inventor: Jonathan Neal Gourlie, Sun Prairie, WI (US)

(73) Assignee: Bock Water Heaters, Inc., Madison, WI (US)

( * ) Notice: Subject to any disclaimer, the term of this patent is extended or adjusted under 35 U.S.C. 154(b) by 0 days.

(21) Appl. No.: 18/783,042

(22) Filed: Jul. 24, 2024

(51) Int. Cl.

| | |
|---|---|
| ***F24H 1/00*** | (2022.01) |
| ***F24H 1/18*** | (2022.01) |
| ***F24H 8/00*** | (2022.01) |
| ***F24H 9/00*** | (2022.01) |

(52) U.S. Cl.
CPC ..... *F24H 9/0031* (2013.01); *F24H 1/18* (2013.01); *F24H 8/006* (2013.01)

(58) Field of Classification Search
CPC ..... F24H 9/0031; F24H 1/18; F24H 8/006
USPC ..... 122/18.31
See application file for complete search history.

(56) References Cited

U.S. PATENT DOCUMENTS

| | | | | |
|---|---|---|---|---|
| 1,933,056 | A * | 10/1933 | Hamilton | F24H 1/205 122/18.31 |
| 2,455,988 | A | 12/1945 | Fife | |
| 4,249,512 | A | 2/1981 | Rivetti et al. | |
| 5,531,484 | A * | 7/1996 | Kawano | F16L 43/00 285/179.2 |
| 8,807,093 | B2 | 8/2014 | Steinhafel | |
| 10,184,690 | B2 | 1/2019 | Steinhafel et al. | |
| 2012/0291719 | A1 * | 11/2012 | Steinhafel | F24H 1/00 122/18.3 |
| 2013/0112155 | A1 * | 5/2013 | Abdel-Rehim | F28D 20/0034 122/15.1 |

OTHER PUBLICATIONS

Cross-sectional view of Bock Water Heaters, Inc., Madison, WI, OT600-900 water heater, sold prior to Jul. 24, 2023.
Screen shot from at 0:58 of YouTube Video, "Rheem(r) Triton TM Triple-Pass Heat Exchanger," https://youtu.be/TvrvVSWYULE?si=d4a9ggl4XirYxHS9, downloaded Jul. 24, 2024.

(Continued)

*Primary Examiner* — Steven B McAllister
*Assistant Examiner* — John E Bargero
(74) *Attorney, Agent, or Firm* — Stiennon & Stiennon

(57) ABSTRACT

A water heater has a heat exchanger positioned within a water tank and connected to an inlet for combustion gases for heating the water within the tank. The heat exchanger has a cylindrical first flue extending downwardly from the inlet with a lower end terminated at a 45-degree first bevel cut. Short fins are fixed to the interior of the first flue. A second cylindrical flue of the same diameter as the first flue extends upwardly parallel to the first flue, and has a 45-degree second bevel cut at its lower end. Longer fins are welded to the interior of the second flue. A cross flue extends between and is directly connected without elbows to the lower ends of the two flues and has 45-degree bevel cuts which are welded to the bevel cuts of the two flues. The right-angle connection of the flues facilitates a compact water heater arrangement.

17 Claims, 3 Drawing Sheets

(56) References Cited

OTHER PUBLICATIONS

"Triton(R) Heavy Duty 80 & 100-Gallon Models," downloaded from chrome-extension://efaidnbmnnnibpcajpcglclefindmkaj/https://media.rheem.com/media/uploads/iat/sites/36/2023/06/RH-102T-REV7-Triton-HD-Feature-Sheet.pdf on Jul. 24, 2024.
"Introducing the new! Triton (R) Super Duty 119-Gallon Model," downloaded from chrome-extension://efaidnbmnnnibpcajpcglclefindmkaj/https://media.rheem.com/media/uploads/iat/sites/36/2023/07/RH-102T-SD-REV3-Triton-SD-Feature-Sheet-.pdf on Jul. 24, 2024.
Cross-sectional view of Bock Water Heaters, Inc., Madison, WI, OT-199N water heater, prior to Jul. 24, 2023.

* cited by examiner

WATER HEATER WITH COMPACT HEAT EXCHANGER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to water heaters in general, and more particularly to high efficiency water heaters.

In heating water with combustion gases in fire tube water heaters, a tank holds the water to be heated, and the combustion of fuel with air in a burner produces combustion gases which heat the water in the tank by passing through one or more flues or tubes extending through the water tank. The gases are very hot as they enter the first downwardly extending flue, and are especially hot at the center of the flue. To promote effective transfer of the heat of the combustion gases to the water, the flues may be provided with interior fins, which are welded to the cylindrical interior wall of the flue in a spiral pattern such as disclosed in U.S. Pat. No. 2,687,747.

The combustion gases entering the first downwardly extending flue or flues is the hottest, and to avoid overheating any internal fins, the initial down flue may be of a wider diameter and may not have internal fins. In water heaters like the ones shown in U.S. Pat. Nos. 10,184,690 and 8,807,093, one or more upwardly extending flues of smaller diameter are connected to the initial down flue by a horizontally extending box-like connector or junction box. These junction boxes are assembled from multiple specially formed parts and add cost to the heater.

The OT600 water heater manufactured by Bock Water Heaters, Inc. of Madison, WI, utilizes smaller internal fins in multiple initial down flues, which do not extend so much into the flue gases flowing closer to the middle of the flue and are hence tolerant of the combined effects of the initial high temperatures of the combustion gases and the high velocity of these gases inherent to high efficiency water heaters. These downwardly extending flues are joined by a junction box to multiple upwardly extending flues, which, due to the cooling combustion gases, are provided with larger internal fins.

For high efficiency hot water heaters, it is desirable to have a heat exchanger with compact volume which makes effective use of space allowing for a large volume of water storage. What is needed is a cost-effective water heater having a compact heat exchanger volume.

SUMMARY OF THE INVENTION

The water heater of the present invention makes use of an initial downwardly extending flue which is of the same diameter as a cross flue and a second upwardly extending flue. Because all three cylindrical flues are of a common diameter, they can be joined with 45-degree angle miter cuts. The steel flues are welded together to form an extremely compact heat exchanger arrangement which is constructed at low cost. Use of shorter internal fins in the first down flue than in the later up flue allows the flue diameters to be the same, enabling the right-angle connection of the two flues and eliminating the requirement of a costly junction box.

It is an object of the present invention to provide a compact heat exchanger for a high efficiency water heater.

It is a further object of the present invention to provide an economical heat exchanger for a high efficiency water heater.

Further objects, features and advantages of the invention will be apparent from the following detailed description when taken in conjunction with the accompanying drawings.

DESCRIPTION OF THE PREFERRED EMBODIMENTS

Figure 1:
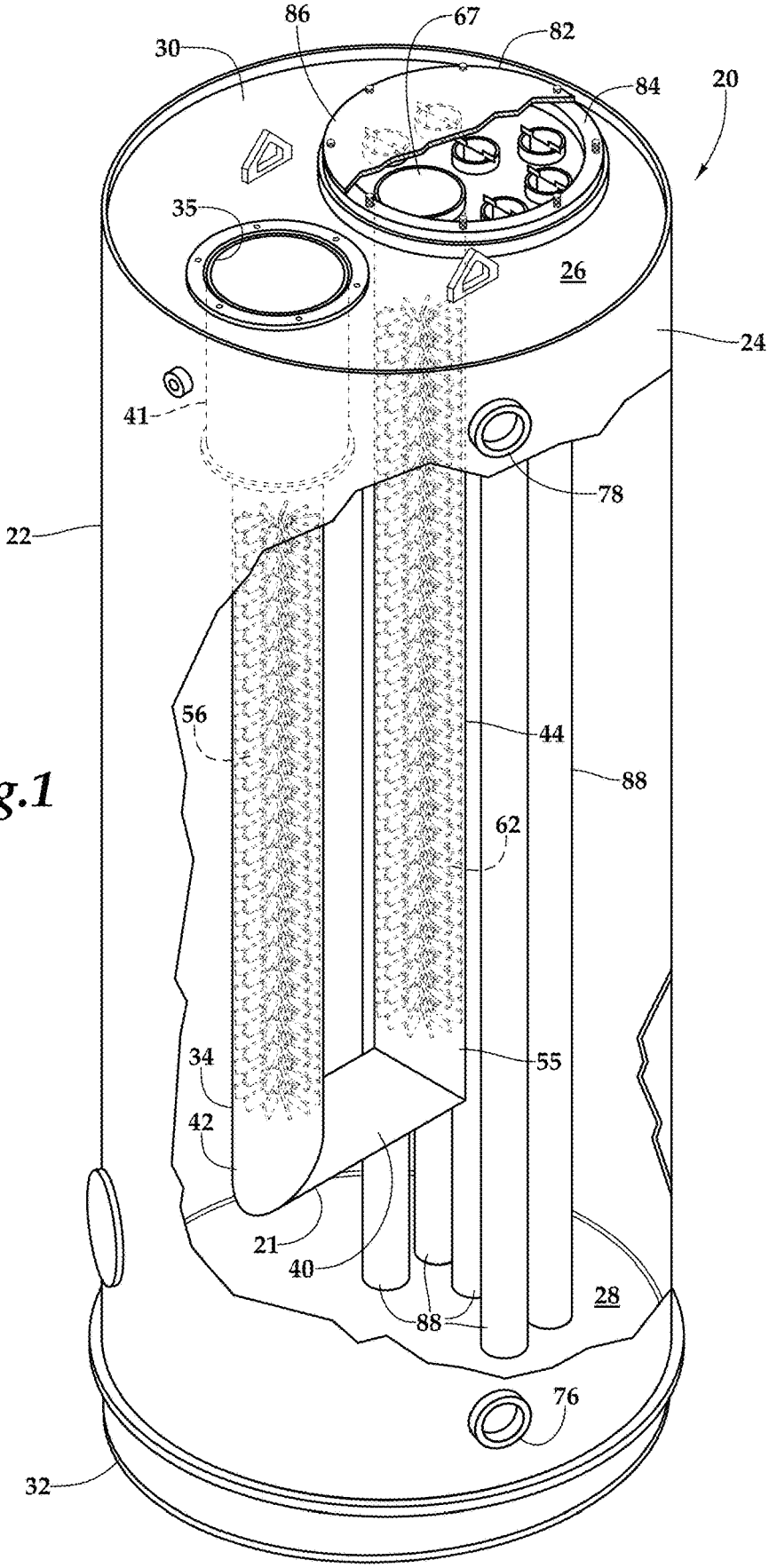
FIG. 1 is an isometric view, partially broken away in section, of a water heater of the invention.
Figure 2:
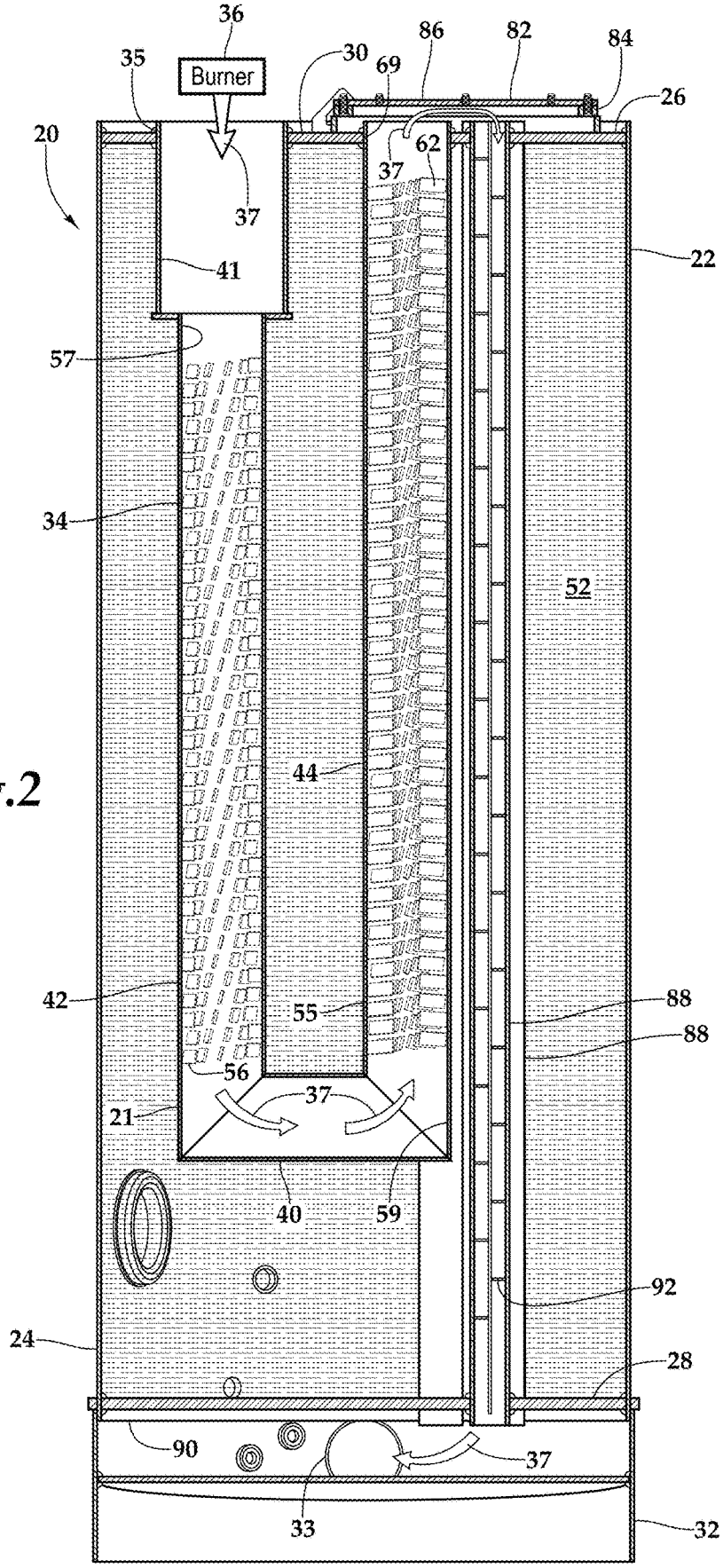
FIG. 2 is a cross-sectional view of the water heater of FIG. 1.

Referring more particularly to FIGS. 1-5 wherein like numbers refer to similar parts, a water heater 20 is shown in FIGS. 1 and 2 having a compact heat exchanger 21. The water heater has a tank 22 formed of a mild steel cylindrical outer shell 24 to which are welded two circular plates, comprising an upper wall 26, and a lower wall 28 of the tank. The tank 22 is provided with an exterior foam insulation, not shown. Mounted below the water tank 22 as a downward continuation of the outer shell is a cylindrical stand 32 having an outlet 33 for the discharge of combustion gases. A heat exchanger assembly 30 includes the heat exchanger 21 fixed to the upper wall 26. As shown in FIG. 1, a water inlet 76 is arranged at the bottom of the tank 22 and a water outlet 78 is arranged at the top of the tank. When hot water is withdrawn, cold water enters the tank 22 and eventually a burner 36 is turned on in response to the temperature drop sensed by a temperature sensor, not shown.

The heat exchanger 21 has cylindrical flues or heat exchanging pipes 34, 40, 44, 88 which are arranged between the upper wall 26 and the lower wall 28. A first flue 34 extends downwardly from an inlet 35 in the upper wall 26. The power burner 36, shown schematically in FIG. 2, is mounted to introduce combustion gases 37 through the inlet 35 into an inlet segment 41 of the first flue 34. The power burner is fired downwardly into the first flue 34 from the upper wall 26. The burner 36 supplies air and natural gas which are burnt to form combustion gases 37, indicated by arrows in FIG. 2, which flow downwardly through the first flue 34.

The first flue 34 has a cylindrical inlet segment 41 which is positioned between the inlet 35 and a cylindrical first flue segment 42. The diameter of the inlet segment 41, which receives the hottest combustion gases, is larger than the diameter of the first flue segment 42. The first flue 34 has a vertical first axis 43. The first flue segment 42 is terminated at a first bevel cut 47. The bevel cut 47 is a miter cut made in the cylindrical first flue segment 42 at a 45-degree angle to the vertical first axis.

The first flue segment 42 is welded to a horizontal second flue 40 which has a second axis 49 which is perpendicular to the first axis 43. The horizontal second flue 40 is terminated at each of its two ends by a second bevel cut 51 which is connected to the first bevel cut 47, and a third bevel cut 53. The second bevel cut 51 and the third bevel cut are each at 45 degrees with respect to a horizontal plane containing the second axis 49. The second flue 40 is of the same diameter as the first flue segment 42, hence the first bevel cut 47 mates with the second bevel cut 51 when welded together to define a watertight seal between the joined flues. The first flue segment 42, second flue 40 and third flue 44 may all be mild steel tubes of about four inches in diameter.

A third flue 44 has a cylindrical third flue segment 55 terminating its lower end. The third flue segment 55 has a third axis 61 which is parallel to the first axis 43. The third flue segment 55 is the same diameter as the first flue segment 42 and is terminated at a fourth bevel cut 63 which is made on a plane which is at a 45-degree angle to a horizontal plane containing the third axis 61. The fourth bevel cut 63 is welded to the third bevel cut 53 of the horizontal second flue 40. The third flue 44 extends upwardly away from the second flue and an upper end 67 of the third flue is connected to a second opening 69 in the upper wall 26.

Because the second flue with its horizontal axis is joined directly to the vertical first flue segment and third flue segment without any intervening elbow or curved flue portion, a very compact heat exchanger arrangement is defined. As a curved section of piping usually requires a bend radius of twice the diameter of the pipe being bent, by avoiding the necessity of bending the flues, a greater amount of vertical flue is available for a given size of heat exchanger, leaving more vertical distance for the ready attachment of internal flue fins. The heat exchanger 21 also does not require a junction box to join the downward flue to the upward flue, saving the cost of special molded or formed parts, instead directly welding the vertical flues to the horizontal flue. A more compact heat exchanger means that there is more volume available within a tank of a given size for storing heated water, thereby increasing the capacity of the tank to serve user need.

Figure 4:
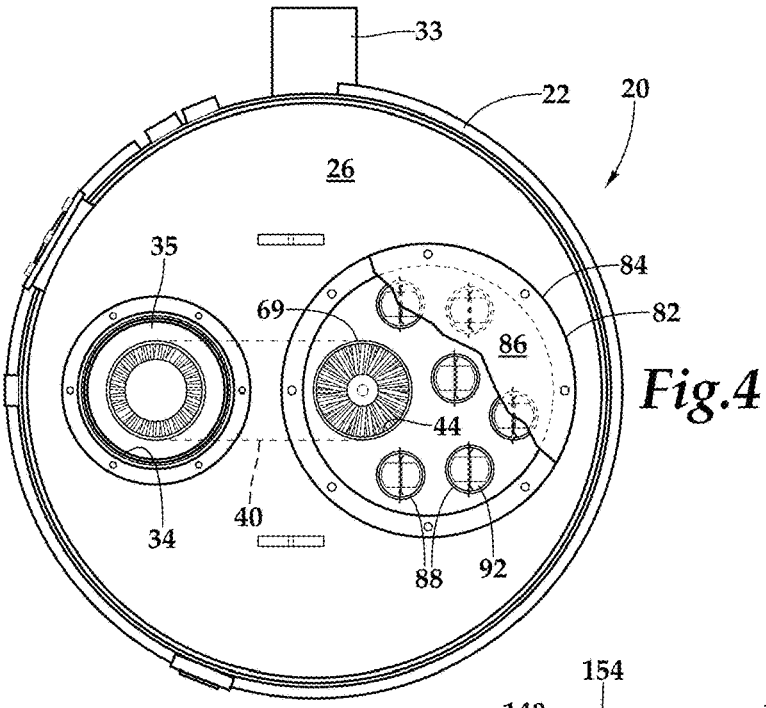
FIG. 4 is a top plan view of the water heater of FIG. 1.

As shown in FIGS. 1 and 4, a junction box 82 is defined above the upper wall 26 by a cylindrical rim 84 having an overlying cover 86. The second opening 69 introduces combustion gases into the junction box 82. Six tertiary flues 88 extend downwardly from the upper wall 26 from the junction box 82 and pass through the water tank lower wall 28. The tertiary flues 88 are cylindrical tubes with vertical axes parallel to the first axis. As shown in FIGS. 2 and 4, internal sheet metal baffles 92 extend within each tertiary flue 88. The baffles have alternately bent plates which break up the flow of combustion gases and promote heat exchange with the surrounding water. The tertiary flues 88 communicate with the exhaust compartment 90 beneath the lower wall 28 allowing the flow of combustion gases out the gas outlet 33. The tertiary flues 88 are arranged so that the combustion gases flow downwardly, so that condensation which forms on the walls and within the flow of combustion gases moves downwardly to a condensate drain connected to the combustion gas outlet 33 extending from the exhaust compartment 90.

As shown in FIG. 2, the combustion gases travel from the power burner 36, downwardly through the first flue, then across through the second flue, to the third flue 44 where they are carried upwardly through the water tank 22 to the upper wall 26, where they are transferred by the junction box 82 to the tertiary flues 88 in which the combustion gases can travel downwardly to the exhaust compartment 90 which connects to a condensate drain connected to the combustion gas outlet 33.

As the combustion gases travel from the power burner 36 through the heat exchanger 21 which extends through a volume of water 52 contained within the tank 22, the combustion gases exchange heat with the walls of the heat exchanger flues. The flow of hot combustion gases is mixed and impeded by a multiplicity of discrete metal fins 56, 62 welded in a spiral pattern within the first flue segment and the third flue. Each fin has a generally rectangular plan, i.e., two long sides and two short sides, and has a thickness of, for example, ⅛ or ¼ inches, and extends radially inwardly substantially toward the axis of the flue. The fins may be formed of mild steel. The design of the finned flues and the placement of the fins forming the heat exchanger is described generally in U.S. Pat. No. 6,957,629 and in U.S. Pat. No. 4,761,532, the disclosures of both of which are incorporated herein by reference.

Figure 3:
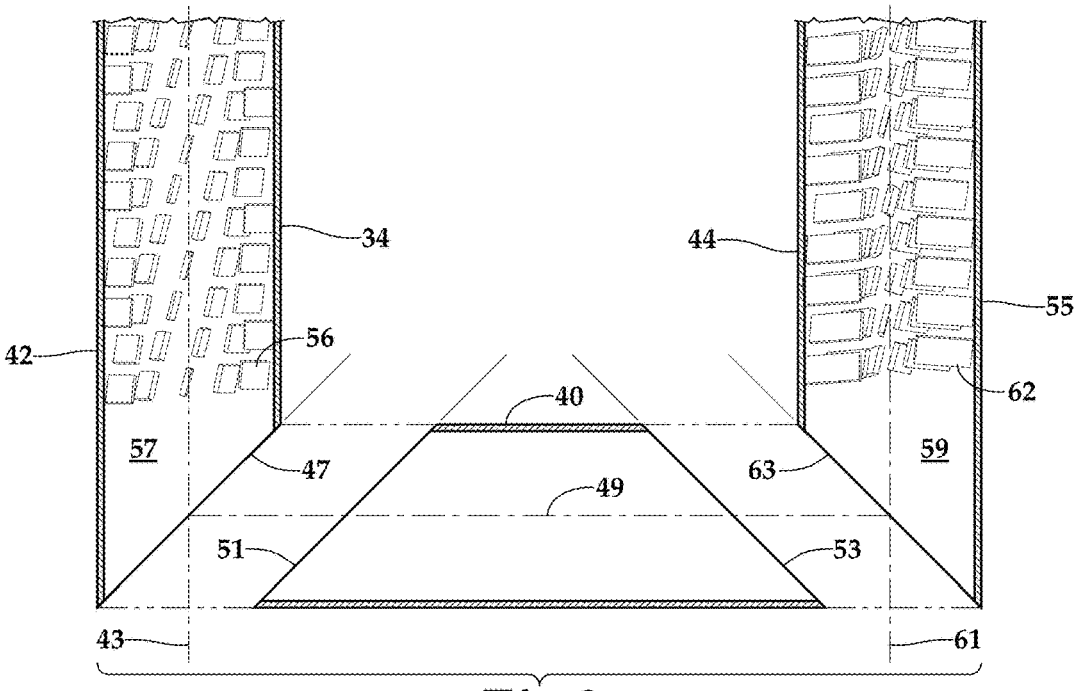
FIG. 3 is an exploded fragmentary cross-sectional view of the heat exchanger of the water heater of FIG. 2, showing the assembly of the miter-cut flue segments to define a right-angle connection.

The first flue segment 42 has first fins 56 welded to the inner surface 57 of the first flue segment. As shown in FIG. 3, the first fins extend in the radial direction a length which is less than half of the radius of the cylindrical first flue segment 42. As a result, the first fins 56 do not extend into the central portion of the first flue where the combustion gases are hottest, reducing the degradation of the first fins. For example, the first fins may be squares ⅝ inch on a side and ⅛ inch thick.

The third flue 44 is provided with second fins 62 welded to the inner surface 59 of the third flue. Because the combustion gases have cooled significantly when they reach the third flue 44, the second fins may extend further into the central region of the flue without suffering degradation. The second fin 62 radial length may be about one third of the diameter of the cylindrical third flue 44. For example, the second fins may be 1¼ inch in the radial direction, ⅝ inch wide and ⅛ inch thick.

Figure 5:
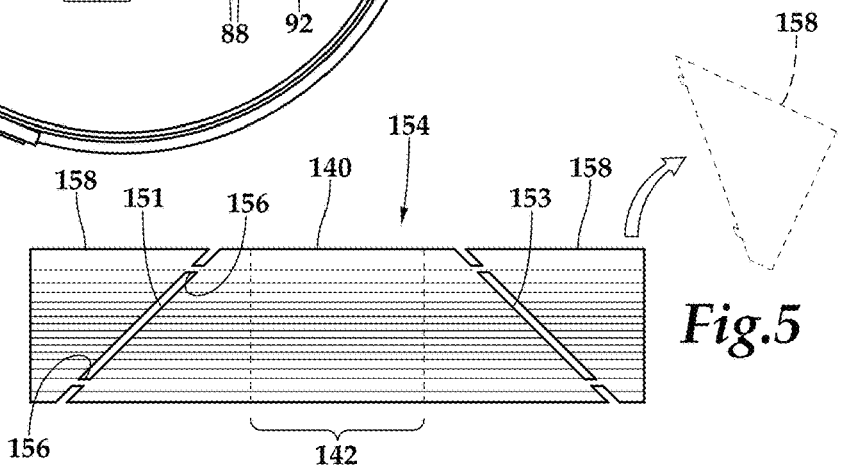
FIG. 5 is a side elevational view of a precursor cross-flue of an alternative embodiment water heater in which a cylindrical tube is formed with pre-cut end pieces, with one shown in exploded phantom view as removed prior to attachment to the downwardly extending and upwardly extending flue segments.

As shown in FIG. 3, the horizontal second flue 40 may be left without internal fins. However, as shown in FIG. 5, an alternative embodiment second flue 140 may be provided with a spiral arrangement of third fins in a region 142 inward of the second bevel cut 151 and the third bevel cut 153. To facilitate the welding of third fins within the horizontal second flue, the fins are attached to a precursor flue element 154 which retains a substantially cylindrical shape. The bevel cuts 151 and 153 in the precursor flue element 154 are segmented so as to leave multiple tabs 156 between peripheral cuts which retain the two outward waste segments 158 to the second flue 140. After attachment of the third fins, the tabs 156 are severed, after which the second flue 140 may be attached to the first flue and the third flue by welding.

It is understood that the invention is not limited to the particular construction and arrangement of parts herein illustrated and described, but embraces all such modified forms thereof as come within the scope of the following claims.

I claim:

1. A water heater comprising:

a water tank having an outer shell extending between an upper wall and a lower wall, wherein the tank has an inlet for connection to a source of combustion gases;

a first flue extending downwardly from the inlet, and terminating at a lower end in a cylindrical first flue segment having a first axis, the first flue segment being terminated at a first bevel cut on a plane which is at a 45-degree angle to the first axis;

a plurality of first fins of a first radial length fixed to the interior of the first flue segment above the first bevel cut, wherein each of the plurality of first fins has an outer end fixed to a cylindrical wall of the first flue segment and an inner end, and wherein each of the plurality of first fins extends radially inwardly substantially toward the first axis from the cylindrical wall of the first flue segment, and wherein the distance in the radial direction from the cylindrical wall to an internal end defines the first radial length;

a cylindrical second flue of a second diameter, and having a second axis which is perpendicular to the first axis, the second flue having a second bevel cut which is at a 45-degree angle to the second axis and which is mated in a water-tight fashion to the first bevel cut of the first flue segment, the second flue having a third bevel cut which is at a 45-degree angle to the second axis and is positioned opposite the second bevel cut, wherein the second flue is spaced above the water tank lower wall a distance greater than the second diameter;

a third flue which terminates at a lower end in a cylindrical third flue segment having a third axis which is parallel to the first axis, the third flue segment being terminated at a fourth bevel cut which is made on a plane which is at a 45-degree angle to the third axis and which is mated in a water-tight fashion to the third bevel cut of the second flue, the third flue extending upwardly away from the second flue; and a plurality of second fins of a second radial length fixed to the interior of the third flue segment above the fourth bevel cut, wherein each of the plurality of second fins has an outer end fixed to a cylindrical wall of the third flue segment and an inner end, and each of the plurality of second fins extends radially inwardly substantially toward the third axis from the cylindrical wall of the third flue segment, a distance in the radial direction from the cylindrical wall of the third flue segment to an internal end defining the second radial length, wherein the second radial length is greater than the first radial length.

2. The water heater of claim 1 further comprising a plurality of fins fixed to an interior of the second flue.

3. The water heater of claim 1 wherein the first flue has an inlet segment positioned between the inlet and the first flue segment, and wherein the inlet segment has a greater diameter than the first flue segment.

4. The water heater of claim 1 wherein the inlet comprises a first opening in the upper wall of the water tank, and wherein the third flue has an upper end which is connected to the upper wall so as to pass combustion gases through a second opening in the upper wall into a compartment positioned above the upper wall.

5. The water heater of claim 4 further comprising a plurality of downwardly extending tertiary flues spaced sidewardly from the third flue and which communicate with the compartment and which receive combustion gases therefrom, the tertiary flues extending through the lower wall of the water tank.

6. The water heater of claim 1 wherein the first flue segment has a radius, and wherein the first fins extend in the radial direction a length which is less than half of the radius.

7. The water heater of claim 6 wherein the third flue has a diameter, and wherein the second fins have a radial length that is about one third of the diameter.

8. A water heater comprising:

a water tank having an outer shell extending between a top wall and a lower wall, with a first opening in the top wall defining an inlet for connection to a source of combustion gases;

a heat exchanger fixed to the top wall, and having a first flue having a first flue segment extending downwardly from the inlet, a second flue segment extending perpendicular to the first flue segment, and a third flue segment extending parallel to the first flue segment and extending to a second opening in the top wall, wherein the second flue segment is welded between the first flue segment and the third flue segment, and the welded flue segments are miter cut to define a right angle connection between the second flue segment and the first flue segment and between the second flue segment and the third flue segment, and wherein the first flue segment, the second flue segment and the third flue segment are cylindrical and have a same first diameter;

a plurality of first fins of a first radial length fixed to an interior of the first flue segment above the second flue segment; wherein each of the plurality of first fins has an outer end fixed to a cylindrical wall of the first flue segment and an inner end, and wherein each of the plurality of first fins extends radially inwardly substantially toward the first axis from the cylindrical wall of the first flue segment, wherein the distance in the radial direction from the cylindrical wall to an internal end defines the first radial length of the first fins; and a plurality of second fins of a second radial length fixed to an interior of the third flue segment above the second flue segment, wherein each of the plurality of second fins has an outer end fixed to a cylindrical wall of the third flue segment and each of the plurality of second fins has an inner end, and each of the plurality of second fins extends radially inwardly substantially toward an axis of the cylindrical third flue segment, and wherein a distance in a radial direction from the cylindrical wall of the third flue segment to an internal end defines the second radial length, wherein the second radial length is greater than the first radial length, and wherein the second flue is spaced above the water tank lower wall a distance greater than the first diameter.

9. The water heater of claim 8 further comprising a plurality of fins fixed to an interior of the second flue segment.

10. The water heater of claim 8 wherein the first flue has an inlet segment positioned between the inlet and the second flue segment, and wherein the inlet segment has a greater diameter than the first flue segment.

11. The water heater of claim 8 wherein a compartment is defined above the second opening which receives combustion gases from the third flue segment.

12. The water heater of claim 11 further comprising a plurality of downwardly extending tertiary flues which communicate with the compartment and which receive combustion gases therefrom, the tertiary flues extending through the lower wall of the water tank.

13. A water heater comprising:

a water tank having an outer shell extending between an upper wall and a lower wall, wherein the tank has an inlet for connection to a source of combustion gases;

a first flue extending downwardly from the inlet, and terminating at a lower end in a cylindrical first flue segment having a vertical axis;

a cylindrical second flue having a horizontal axis and connected directly to the first flue segment;

a cylindrical third flue having a vertical axis and connected directly to the second flue, the third flue extending upwardly away from the second flue, wherein the first flue segment, and the third flue are a same diameter as the second flue where they join the second flue; and a plurality of first fins of a first radial length fixed to an interior of the first flue segment above the second flue, wherein each of the plurality of first fins has an outer end fixed to a cylindrical wall of the first flue segment and each of the plurality of first fins has an inner end, and wherein each of the plurality of first fins extends radially inwardly substantially toward the vertical axis of the first flue segment from the cylindrical wall of the first flue segment, the distance in the radial direction from the cylindrical wall to an internal end defines the first radial length; and a plurality of second fins of a second radial length fixed to an interior of the third flue above the second flue, wherein each of the plurality of second fins has an outer end fixed to a cylindrical wall of the third flue and each of the plurality of second fins has an inner end, and each of the plurality of second fins extends radially inwardly substantially toward the third flue vertical axis from the cylindrical wall of the third flue, wherein a distance in the radial direction from the cylindrical wall of the third flue to a second fin internal end defines the second radial length, the second radial length being greater than the first radial length, and wherein the second flue has a diameter, and wherein the second flue is spaced above the water tank lower wall a distance greater than the diameter of the second flue.

14. The water heater of claim 13 further comprising a plurality of third fins fixed to an interior of the second flue.

15. The water heater of claim 13 wherein the first flue has an inlet segment positioned between the inlet and the first flue segment, and wherein the inlet segment has a greater diameter than the first flue segment.

16. The water heater of claim 13 wherein the inlet comprises a first opening in the upper wall of the water tank, and wherein the third flue has an upper end which is connected to the upper wall so as to pass combustion gases through a second opening in the upper wall into a compartment positioned above the upper wall.

17. The water heater of claim 16 further comprising a plurality of downwardly extending tertiary flues which communicate with the compartment and which receive combustion gases therefrom, the tertiary flues extending through the lower wall of the water tank.

* * * * *